US007167669B2

(12) United States Patent
Murata et al.

(10) Patent No.: US 7,167,669 B2
(45) Date of Patent: Jan. 23, 2007

(54) IMAGE FORMING APPARATUS

(75) Inventors: Shigemi Murata, Kanagawa (JP); Junichi Hama, Kanagawa (JP); Tomio Onuki, Kanagawa (JP); Ryuji Hattori, Kanagawa (JP); Yoshiyuki Takashima, Kanagawa (JP); Teruaki Koizumi, Kanagawa (JP); Satoru Yugeta, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/063,982

(22) Filed: Feb. 24, 2005

(65) Prior Publication Data

US 2006/0051137 A1 Mar. 9, 2006

(30) Foreign Application Priority Data

Sep. 3, 2004 (JP) ..... P2004-257338

(51) Int. Cl.
*G03G 15/09* (2006.01)

(52) U.S. Cl. ..... 399/277; 399/299; 399/223

(58) Field of Classification Search ..... 399/299, 399/277, 223, 231, 367, 275, 179, 267
See application file for complete search history.

(56) References Cited

U.S. PATENT DOCUMENTS 5,987,291 A * 11/1999 Masuda ..... 399/299
6,356,718 B1 * 3/2002 Matsumoto ..... 399/299
6,537,714 B2 * 3/2003 Kaya et al. ..... 399/223
6,938,351 B2 * 9/2005 Kobayashi et al. ..... 33/299
2004/0096245 A1 * 5/2004 Kai et al. ..... 399/277

FOREIGN PATENT DOCUMENTS

JP 2000-242057 A 9/2000
JP 2001-347384 A 12/2001

OTHER PUBLICATIONS

JPO Machine Translation of JP 2000-242057 A; Sep. 8, 2000.*

* cited by examiner

*Primary Examiner*—David M. Gray
*Assistant Examiner*—Erika J. Villaluna
(74) *Attorney, Agent, or Firm*—Morgan, Lewis & Bockius, LLP

(57) ABSTRACT

An image forming apparatus includes plural toner image forming devices. Each of which has a rotating photoconductor, a charging device that uniformly charges a surface of the photoconductor, a latent image forming device that forms an electrostatic latent image on the surface of the charged photoconductor, a developing device that develops the electrostatic latent image on the surface of the photoconductor to a toner image, and a developing container that contains toner used by the developing device. A diameter of the photoconductor of at least one toner image forming device is formed larger than a diameter of the photoconductor of the other toner image forming devices. Each developing container of all the toner image forming devices is formed in equal-sized, and a center of rotation of a developing roll of each developing device is arranged in a position upper than a center of rotation of each photoconductor.

6 Claims, 3 Drawing Sheets

IMAGE FORMING APPARATUS

BACKGROUND OF THE INVENTION

1. Field of the Invention

The present invention relates to an image forming apparatus such as a printer, a FAX and a copying machine, and particularly to an image forming apparatus including plural toner image forming devices having a photoconductor and a developing device that develops an electrostatic latent image formed on a surface of the photoconductor to a toner image.

2. Description of the Related Art

Conventionally, in an electrophotographic type color image forming apparatus such as a printer, a FAX and a copying machine, a rotary type image forming apparatus (refer to FIG. 19 of JP-A-2001-347384, for example) that forms toner images of plural colors by switching plural developing devices with respect to one photoconductor and a tandem type image forming apparatus (refer to FIGS. 20 and 21 of JP-A-2001-347384, for example) that includes plural toner image forming devices each having one photoconductor and one developing device corresponding to one color and forms a toner image of each color by each of the toner image forming devices have been known.

The tandem type image forming apparatus is easy to form an image at high speed as compared with the rotary type image forming apparatus, but there is a problem that a size of the image forming apparatus tends to increase as compared with the rotary type image forming apparatus since combination of the photoconductor and the developing device aligns in a horizontal direction or a vertical direction, and there is a problem from a viewpoint of miniaturization of the image forming apparatus.

Also, in recent years, performance (printing speed, productivity) equal to or higher than that of a monochrome (black and white) image forming apparatus has been required with respect to the tandem type color image forming apparatus. It is necessary to rotate a photoconductor at high speed in order to improve productivity of a monochrome image in a color image forming apparatus. When a roll-shaped charging device is used as a charging device for uniformly charging a surface of the photoconductor in this case, there is a possibility that the surface of the photoconductor rotating at high speed cannot be charged sufficiently since charging is performed in only a narrow discharge region in which the charging roll makes contact with the surface of the photoconductor. Therefore, a corona discharger which can cope with high-speed rotation and has a relatively wide electric discharge region is desirably adopted as the charging device. However, in the case of using the corona discharger, a small diameter of the photoconductor (large curvature) increases dissipating charges even when the discharge region of the corona discharger is widened, so that it is necessary to increase the diameter of the photoconductor as compared with the case of using the charging roll and there is a problem of upsizing of the image forming apparatus.

Also, a technique for making a diameter of a photoconductor of black color larger than those of photoconductors of other colors in a tandem type image forming apparatus is described in JP-A-2000-242057. In this reference, a charging device and a developing device are larger than those of other colors since space of the periphery of the photoconductor increases by upsizing the diameter of the photoconductor of black color. Also, it is possible to use the charging device etc. of the same size and structure as those of the charging device etc. of other colors instead of the larger charging device, the developing device, etc. of black color.

In the technique described in JP-A-2000-242057, when the developing device or the charging device is upsized, there are problems that it acts to a disadvantage to miniaturization of the image forming apparatus and also the developing device etc. of black color require components separate from those of the developing device etc. of other colors and cost increases. Also, when the charging devices or the developing devices with the same size and structure are used in the charging devices or the developing devices of all the colors, it is necessary to arrange developing devices in the same position with respect to the photoconductors with different radii (curvatures) since positions of magnetic poles of magnet rolls used in developing rolls of the developing devices are the same. Therefore, arrangement of the photoconductors and the developing devices is limited and, for example, positions of the developing devices are limited at 3 o'clock position of the photoconductors as described in FIG. 2 of JP-A-2000-242057. When the positions of the developing devices are set at 3 o'clock position of the photoconductors, there is a problem that a lateral size of a toner image forming device increases and the image forming apparatus cannot be miniaturized.

SUMMARY OF THE INVENTION

In view of the circumstances described above, the invention addresses cost reduction and miniaturization of an image forming apparatus while improving productivity.

According to an aspect of the invention, an image forming apparatus includes plural toner image forming devices each of which has a rotating photoconductor, a charging device that uniformly charges a surface of the photoconductor, a latent image forming device that forms an electrostatic latent image on the surface of the charged photoconductor, a developing device that develops the electrostatic latent image on the surface of the photoconductor to a toner image, and a developing container that contains toner used by the developing device. A diameter of the photoconductor of at least one toner image forming device is formed larger than a diameter of the photoconductor of the other toner image forming devices. Each developing container of all the toner image forming devices is formed in equal-sized, and a center of rotation of a developing roll of each developing device is arranged in a position upper than a center of rotation of each photoconductor.

BRIEF DESCRIPTION OF THE DRAWING

Embodiment of the present invention will be described in detail based on the following figures, wherein:

FIG. 2 is a main enlarged explanatory diagram of a toner image forming device of the embodiment, FIG. 3 is an explanatory diagram describing positions of magnetic poles of a magnet roll of a developing device.

DETAILED DESCRIPTION OF THE INVENTION

Figure 1:
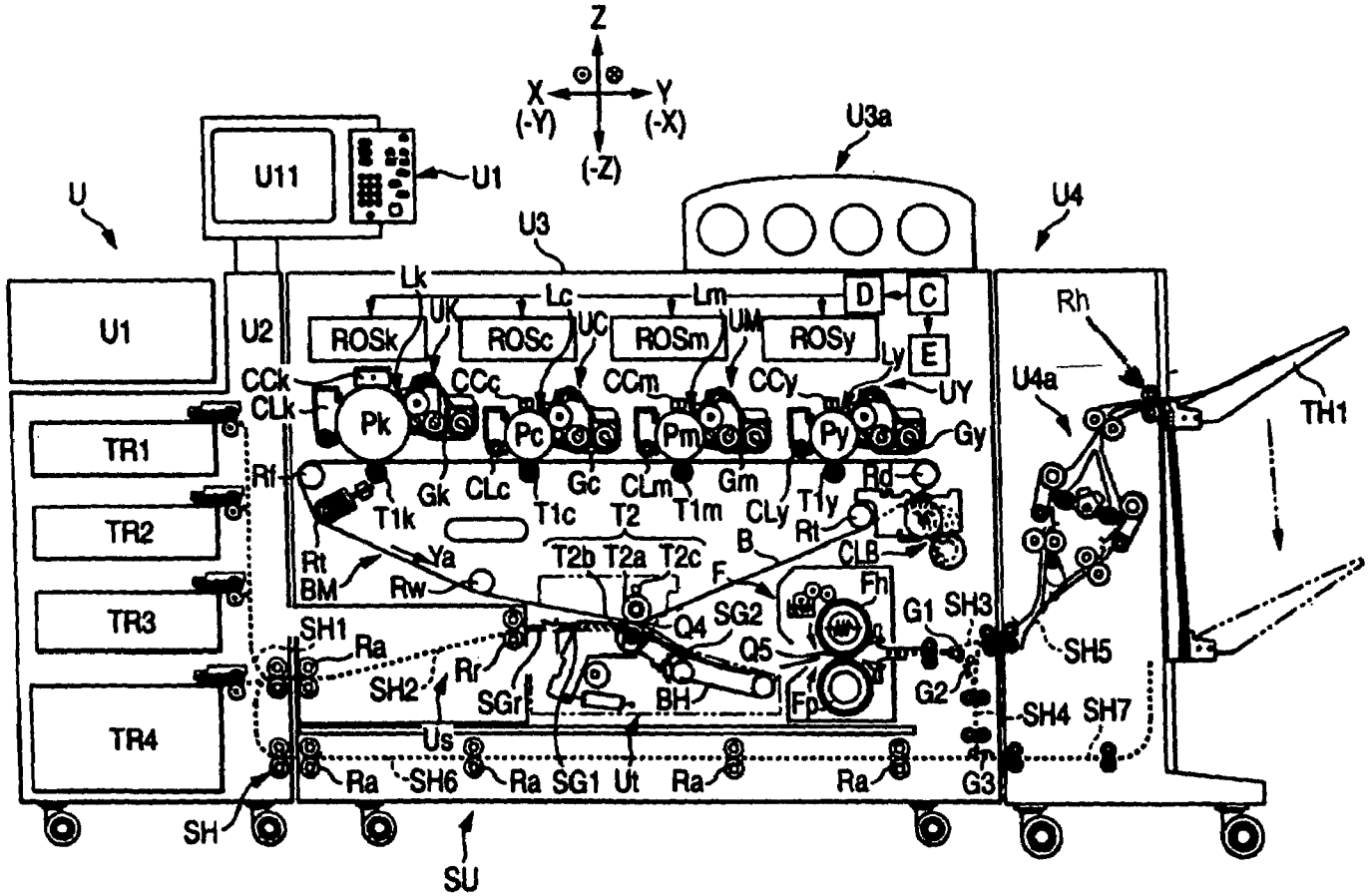
FIG. 1 is a whole explanatory diagram of an image forming apparatus (tandem type digital color copying machine) of an embodiment of the invention.

Next, an embodiment of the invention will be described with reference to the drawings, but the invention is not limited to the following example.

For ease of understanding of the subsequent description, it is assumed that a front and back direction is a direction of an X axis, a right and left direction is a direction of a Y axis, an upper and lower direction is a direction of a Z axis and the directions or sides shown by arrows X, −X, Y, −Y, Z, −Z are respectively the front, back, right, left, upper, lower, or the front side, back side, right side, left side, upper side, lower side in the drawings.

Also, in the drawings, a mark in which "•" is shown in "O" means an arrow from the back toward the front of the page and a mark in which "x" is shown in "O" means an arrow from the front toward the back of the page.

FIG. 1 is a whole explanatory diagram of an image forming apparatus (tandem type digital color copying machine) of an embodiment of the invention.

In FIG. 1, an image forming apparatus U has a UI (user interface), an image input device U1, a sheet feeding device U2, an image forming apparatus body U3 and a sheet processing device U4.

The UI has a copy start key (not shown), input keys such as a numeric keypad and a display device UI1.

The image input device is configured with an automatic document transport device and an image scanner, etc.

In FIG. 1, in the image input device U1, reflected light from a document (not shown) illuminated is converted into image data of R (red), G (green) and B (blue) by an exposure optical system (not shown), a CCD (charge-coupled device) and an image processing circuit (not shown), and is inputted to the image forming apparatus body U3 at predetermined timing.

The sheet feeding device U2 has plural sheet feeding trays TR1 to TR4, and a sheet feeding path SH1 for taking out a recording sheet S for image record accommodated in each of the sheet feeding trays TR1 to TR4 and transporting the recording sheet S to the image forming apparatus body U3.

In FIG. 1, the image forming apparatus body U3 has an image recording part (details will be described later) for recording an image on the recording sheet S transported from the sheet feeding device U2, a toner dispenser device U3*a*, a skew correction path SH2, a sheet delivery path SH3, a sheet reversal path SH4, a sheet circulation path SH6, etc.

Also, the image forming apparatus body U3 has a controller C, and a laser driving circuit D and a power source circuit E, etc. controlled by the controller C. The laser driving circuit D whose actuation is controlled by the controller C outputs laser driving signals according to image data of Y (yellow), M (magenta), C (cyan), K (black) inputted from the image input device U1 to latent image forming devices ROSy, ROSm, ROSk of toner image forming devices UY, UM, UC, UK of each color at predetermined timing. Incidentally, the toner image forming devices UY, UM, UC, UK of each color are movably supported between a drawing position drawn to the front of the image forming apparatus body U3 and an attachment position attached to the inside of the image forming apparatus body U3.

In FIG. 1, a charging device CCk, a developing device Gk, a cleaner CLk, etc. are arranged in the periphery of a photoconductor drum (toner image carrier) Pk of the toner image forming device UK of K (black).

Then, charging devices CCy, CCm, CCc, developing devices Gy, Gm, Gc, cleaners CLy, CLm, CLc, etc. similar to those of the periphery of the photoconductor drum Pk are also arranged in the peripheries of the photoconductor drums Py, Pm, Pc of the other toner image forming devices UY, UM, UC, respectively.

In FIG. 1, after the photoconductor drums Py, Pm, Pc, Pk are uniformly charged by the charging devices (corona dischargers) CCy, CCm, CCc, CCk, respectively, electrostatic latent images are formed on the surfaces of the photoconductor drums by laser beams Ly, Lm, Lc, Lk outputted by the latent image forming devices ROSy, ROSm, ROSc, ROSk. The electrostatic latent images of the surfaces of the photoconductor drums Py, Pm, Pc, Pk are developed to toner images of colors of Y (yellow), M (magenta), C (cyan), K (black) by the developing devices Gy, Gm, Gc, and Gk.

The toner images on the surfaces of the photoconductor drums Py, Pm, Pc, Pk are sequentially superimposed and transferred on an intermediate transfer belt B by primary transfer rolls T1*y*, T1*m*, T1*c*, T1*k*, and a color image is formed on the intermediate transfer belt B. A color toner image formed on the intermediate transfer belt B is transported to a secondary transfer region Q4.

In a case where there is only black image data, only the developing device Gk and the photoconductor drum Pk of K (black) are used and only a black toner image is formed.

After primary transfer, residual toner on the surfaces of the photoconductor drums Py, Pm, Pc, Pk is cleaned by the cleaners CLy, CLm, CLc, CLk for photoconductor drums.

A belt module BM has the intermediate transfer belt B, belt support rolls (Rd, Rt, Rw, Rf, T2*a*) including a belt driving roll Rd, a tension roll Rt, a walking roll Rw, plural idler rolls (free rolls) Rf and a backup roll T2*a*, and the primary transfer rolls T1*y*, T1*m*, T1*c*, T1*k*. Then, the intermediate transfer belt B is supported rotatably movably in a direction of an arrow Ya by the belt support rolls (Rd, Rt, Rw, Rf, T2*a*).

A secondary transfer unit Ut is arranged in a lower portion of the backup roll T2*a*. A secondary transfer roll T2*b* of the secondary transfer unit Ut is arranged so as to be able to break and make pressure contact (break and make contact) with the backup roll T2*a* with the intermediate transfer belt B sandwiched between the rolls, and the secondary transfer region Q4 is formed by a region (nip) in which the secondary transfer roll T2*b* makes pressure contact with the intermediate transfer belt B. Also, a contact roll T2*c* abuts on the backup roll T2*a*, and a secondary transfer machine (transfer device) T2 is configured with the rolls T2*a* to T2*c*.

A secondary transfer voltage of the same polarity as charging polarity of toner is applied to the contact roll T2*c* at predetermined timing from a power source circuit controlled by the controller C.

In FIG. 1, a skew correction unit Us is arranged in a lower portion of the belt module BM. The recording sheet S fed from the sheet feeding path SH1 of the sheet feeding device U2 is transported to the skew correction unit Us. A side guide (not shown) for aligning the side edge of the sheet is arranged in the skew correction path SH2 of the skew correction unit Us, and three crossed rolls Rc (oblique rolls, sheet transport device, not shown in the figure) are arranged along the side guide. Therefore, the sheet transported on the skew correction path SH2 is transported to the side of the side guide by the crossed rolls Rc and is transported to a registration roll (sheet transport device) Rr with the side edge of the sheet aligned.

The sheet transported to the registration roll Rr is timed to the time of transporting a color toner image to the secondary transfer region Q4 and is transported to the secondary transfer region Q4 through a registration side sheet guide SGr and a sheet guide SG1.

The registration side sheet guide SGr is fastened to the image forming apparatus body U3 together with the registration roll Rr.

The color toner image on the intermediate transfer belt B is transferred to the recording sheet S by the secondary transfer machine T2 in a case of passing through the secondary transfer region Q4. Incidentally, for a full color image, primarily transferred toner images superimposed on the intermediate transfer belt B are secondarily transferred to the recording sheet S all together.

The intermediate transfer belt B after the secondary transfer is cleaned by a belt cleaner CLB. Incidentally, the secondary transfer roll T2*b* and the belt cleaner CLB are disposed so as to be able to break and make contact (capable of breaking and making contact) with the intermediate transfer belt B.

The recording sheet S to which the toner images are secondarily transferred is transported to a region (fixing region) Q5 in which a pair of a fixing roll Fh and a pressurizing roll Fp of a fixing device F make pressure contact through a sheet guide SG2 and a curl correction belt BH after transferred. The toner images on the recording sheet S are heated and fixed by the fixing device F in a case of passing through the fixing region Q5.

A switching gate G1 is provided in the downstream side of the fixing device F. The switching gate G1 selectively switches between a sheet delivery path SH3 and a sheet reversal path SH4 of the sheet processing device U4 for the recording sheet S transported on the skew correction path SH2, heated and fixed in the fixing region Q5. The sheet S transported to the sheet delivery path SH3 is transported to a curl correction path SH5 of the sheet processing device U4 and curl (curl tendency of sheet) is corrected by a curl correcting device U4*a* arranged in the curl correction path SH5 and then the sheet is delivered from a delivery roll Rh to a delivery tray TH1 of the sheet processing device U4 in face-up state (with an image fixing surface of sheet set upward).

The sheet transported to the side of the sheet reversal path SH4 of the image forming apparatus body U3 by the switching gate G1 is transported to the sheet reversal path SH4 of the image forming apparatus body U3 through a mylar gate G2 made of a sheet-like member. The sheet transported to this sheet reversal path SH4 can be delivered from the sheet delivery tray TH1 of the sheet processing device U4 in face-down state (with an image fixing surface of sheet set downward) by transporting the sheet to the curl correction path SH5 after reversal. In that case, the sheet is switched back immediately after the back end of the sheet passes through the mylar gate G2. In the mylar gate G2, when the recording sheet S transported to the sheet reversal path SH4 is once passed as it is and the passed recording sheet S is switched back and transported, the recording sheet S is transported to the side of the curl correction path SH5.

On the way to the sheet reversal path SH4 of the image forming apparatus body, a sheet circulation path SH6 is connected and in its connection part, a mylar gate G3 is disposed. The downstream end of the sheet reversal path SH4 of the image forming apparatus body is connected to a sheet reversal path SH7 of the sheet processing device U4.

The sheet transported to the sheet reversal path SH4 through the switching gate G1 is transported to the side of the sheet reversal path SH7 of the sheet processing device U4 by the mylar gate G3. In the mylar gate G3, the recording sheet S transported to the sheet reversal path SH4 is once passed and then switched back, and the sheet switched back is guided to the side of the sheet circulation path SH6.

The recording sheet S transported to the sheet circulation path SH6 is again transported to the secondary transfer region Q4 through the skew correction path SH2.

A sheet transport path SH is configured with the components shown by the numerals SH1 to SH7. Also, a sheet transport device SU is configured with the component shown by the numerals SH, Ra, Rh, SG1, SG2, BH, and G1 to G3.

Figure 2A:
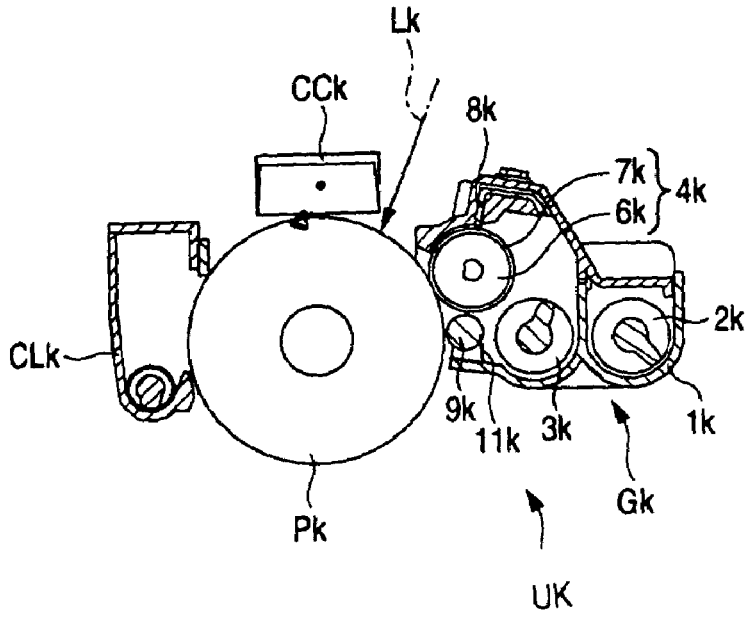
FIG. 2A is an explanatory diagram of a developing device of K color and FIG. 2B is an explanatory diagram of developing devices of other colors.
Figure 2B:
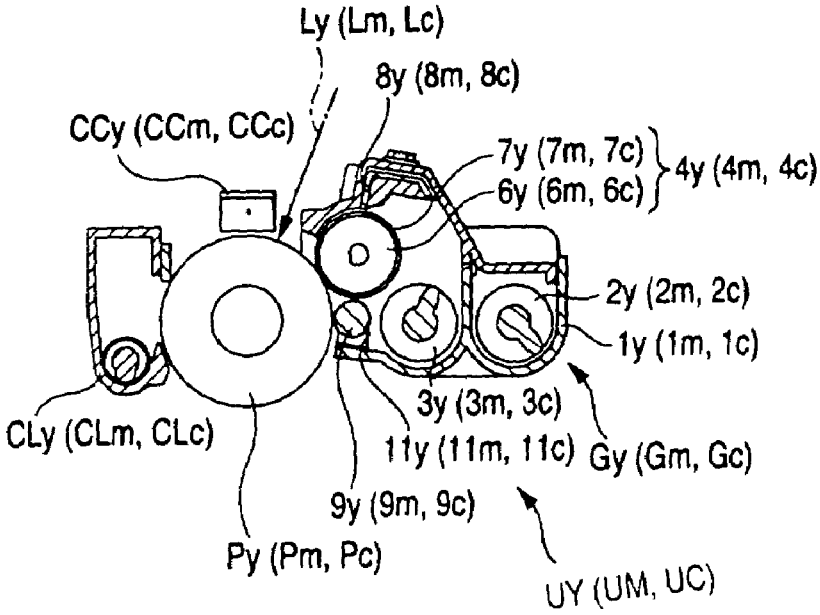

FIG. 2 is a main enlarged explanatory diagram of the toner image forming device of the embodiment and FIG. 2A is an explanatory diagram of a developing device of K color and FIG. 2B is an explanatory diagram of developing devices of other colors.

In FIG. 2A, a developing device Gk of black (K) color has a developing container 1*k* for containing a developer including toner and a carrier. Circulation stirring members 2*k*, 3*k* for performing frictional charging while circulating and transporting the developer and stirring the toner and the carrier are received inside the developing container 1*k*. A developing roll 4*k* facing a photoconductor Pk is supported in a position adjacent to an oblique upper portion of the left circulation transport member 3*k*. The developing roll 4*k* has a magnet roll 6*k* fastened and supported, and a rotatable developing sleeve 7*k* arranged in the periphery of the magnet roll 6*k*. A magnetic carrier is attracted to a surface of the developing sleeve 7*k* by magnetic force of the magnet roll 6*k*, and charged toner is attracted to the carrier. A development bias is applied to the developing roll 4*k* and in a development region facing the photoconductor Pk, the toner moves to an exposure portion of a surface of the photoconductor Pk and an electrostatic latent image is developed to a toner image.

A layer thickness regulation member 8*k* for regulating a thickness of the developer adhering to the surface of the developing sleeve 7*k* is supported in an upper portion of the developing roll 4*k*. A metal seal roll 9*k* driven and rotated in a direction opposite to a direction of rotation of the photoconductor Pk is arranged in a lower portion of the developing roll 4*k*. A scraper 11*k* abutting on a surface of the seal roll 9*k* is fastened and supported in the right of the seal roll 9*k*. A bias having a polarity opposite to that of toner is applied to the seal roll 9*k*, and the toner in a cloud-state in a development region etc. is stuck to the surface of the seal roll 9*k*. The stuck toner is scraped by the scraper 11*k* and is recovered inside the developing container 1*k*.

Figure 3A:
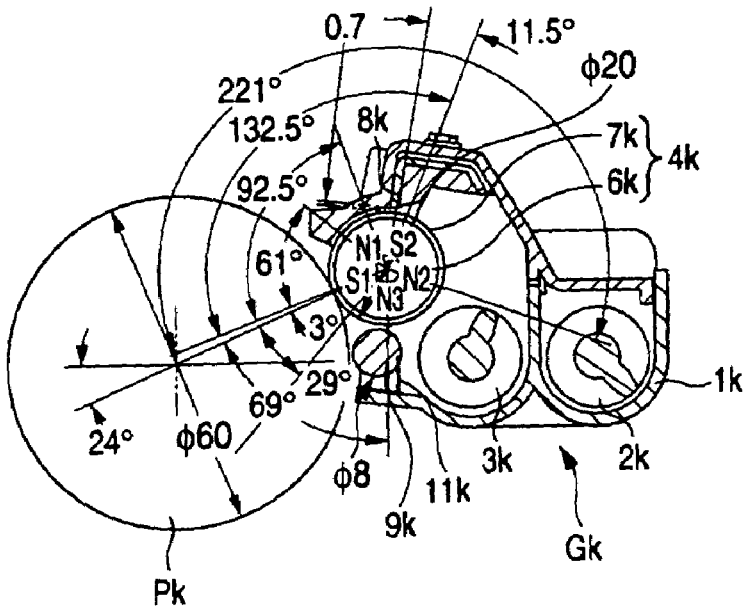
FIG. 3A is an explanatory diagram of positions of magnetic poles of a magnet roll of K color and FIG. 3B is an explanatory diagram of positions of magnetic poles of a magnet roll of other color.
Figure 3B:
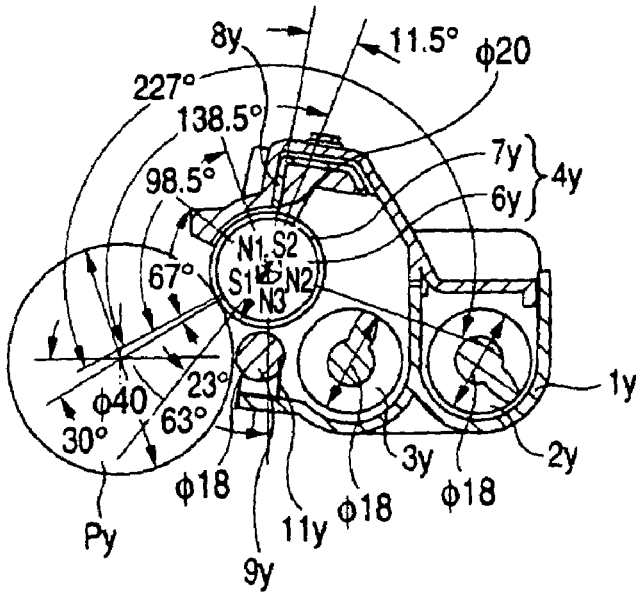

FIG. 3 is an explanatory diagram describing positions of magnetic poles of a magnet roll of a developing device and FIG. 3A is an explanatory diagram of positions of magnetic poles of a magnet roll of K color and FIG. 3B is an explanatory diagram of positions of magnetic poles of a magnet roll of other colors.

In FIG. 3A, the magnet roll 6*k* has a development magnetic pole S1, which is arranged in a position facing the photoconductor Pk and directs toner adhering to a carrier of a surface of the developing sleeve 7*k* to the side of the photoconductor Pk. A transport magnetic pole N1 for transporting a developer adhering to the developing sleeve 7*k* to the development magnetic pole S1 is arranged in the upstream side of a rotation direction of the developing sleeve 7*k* of the development magnetic pole S1. A trimming magnetic pole 52 for directing toner outward in order to regulate a layer thickness by the layer thickness regulation member 8*k* is arranged in the upstream side of the transport magnetic pole N1. A first repulsion magnetic pole N2 is arranged in the upstream side of the trimming magnetic pole S2 and a second repulsion magnetic pole N3 is arranged in the further upstream side. By the repulsion magnetic poles N2 and N3, the toner adhering to the surface of the developing sleeve 7*k* after passing through a development region is separated from the developing sleeve 7*k* and is returned to the inside of the developing container 1*k*.

As shown in FIG. 3A, an outer diameter of the developing roll 4*k* of the embodiment is set at 20 mm and an outer diameter of the photoconductor Pk is set at 60 mm. Also, outer diameters of the circulation stirring members 2*k*, 3*k* are set at 18 mm and an outer diameter of the seal roll 9*k* is set at 8 mm (see FIG. 3B). The developing device Gk is arranged so that a line segment making connection between the center of rotation of the developing roll 4*k* and the center of rotation of the photoconductor Pk is set in a position of an upper portion by 24° with respect to the horizontal axis passing through the center of rotation of the photoconductor Pk.

As shown in FIG. 3A, in the magnet roll 6*k* of the embodiment, the development magnetic pole S1 is arranged in a position of the upstream side of a rotation direction of the developing sleeve 7*k* by 3° with respect to the line segment making connection between the center of rotation of the developing roll 4*k* and the center of rotation of the photoconductor Pk. The transport magnetic pole N1 is arranged in a position of the upstream side by 61° with respect to the development magnetic pole S1, and the trimming magnetic pole S2 is arranged in a position of the upstream side by 132.5° with respect to the development magnetic pole S1. Also, the first repulsion magnetic pole N2 is arranged in a position of the upstream side by 221° with respect to the development magnetic pole S1, and the second repulsion magnetic pole N3 is arranged in a position of the downstream side by 69° with respect to the development magnetic pole S1. Also, the layer thickness regulation member 8*k* is arranged in a position of the downstream side by 11.5° with respect to the trimming magnetic pole S2, and a gap between the top of the layer thickness regulation member 8*k* and the surface of the developing sleeve 7*k* is set at 0.7 mm.

Also, a zero point between the development magnetic pole S1 and the second repulsion magnetic pole N3 (a position where a magnetic flux density becomes zero) is arranged in a position of the downstream side by 29° with respect to the development magnetic pole S1, and a zero point between the transport magnetic pole N1 and the trimming magnetic pole S2 is arranged in a position of the upstream side by 92.5° with respect to the development magnetic pole S1.

In FIGS. 2B and 3B, in toner image forming devices UY, UM, UC of colors (yellow (Y), magenta (M), cyan (C)) other than K color, outer diameters of photoconductors Py to Pc are set at 40 mm unlike the photoconductor Pk of UK. Developing devices Gy to Gc have the same configuration as that of the developing device Gk of UK except for arrangement positions of the developing devices Gy to Gc with respect to the photoconductors Py to Pc and positions of development magnetic poles Si of magnet rolls 6*y* to 6*c*. That is, all of the sizes and shapes of developing containers 1*y* to 1*c*, the outer diameters of developing rolls 4*y* to 4*c* and the positions of magnetic poles N1 to N3 and S2 other than the development magnetic poles S1 of the magnet rolls 6*y* to 6*c* have the same configuration. Further, the multiple reference signs shown in FIG. 2B directly correspond to unitary reference signs shown in FIG. 2A e.g., reference signs 2*y*, 2*m*, and 2*c* in FIG. 2B correspond to reference sign 2*k* in FIG. 2A.

In FIG. 3B, the developing devices Gy to Gc are arranged so that line segments making connection between the centers of rotations of the developing rolls 4*y* to 4*c* and the centers of rotations of the photoconductors Py to Pc are set in positions of upper portions by 30° with respect to the horizontal axis passing through the centers of rotations of the photoconductors Py to Pc. In a manner similar to the development magnetic pole S1 of K, the development magnetic poles S1 of the magnet rolls 6*y* to 6*c* are arranged in positions of the upstream sides of rotation directions of developing sleeves 7*y* to 7*c* by 3° with respect to the line segments making connection between the centers of rotations of the developing rolls 4*y* to 4*c* and the centers of rotations of the photoconductors Pv to Pc. However, the positions of the photoconductors Py to Pc with respect to the developing devices Gy to Gc differ by 6° (=3°−24°, so that positions of the development magnetic poles S1 of Y color, M color, C color with respect to arrangement positions of the other magnetic poles N1 to N3 and S2 are arranged to the downstream sides by 6° with respect to the position of the development magnetic pole S1 of K color.

In the image forming apparatus U of the embodiment having the configuration described above, an outer diameter of the photoconductor Pk of K (black) is formed larger than outer diameters of the photoconductors Py to Pc of other colors. Therefore, dissipating charges in a discharge region decreases in the case of using the charging device CCk of a corona discharge type capable of coping with high-speed printing. As a result of this, productivity of black and white images can be improved. Also, since a diameter of the photoconductor Pk is large and a circumferential length of the surface is long, frequency of use of the same portion of the surface of the photoconductor is reduced, so that life of the photoconductor Pk of K color with high frequency of use can be increased. Also, in the image forming apparatus U of the embodiment, members other than the magnet roll 6*k* of the developing device Gk are shared although the outer diameter of the photoconductor Pk of K (black) is formed larger than the outer diameters of the other photoconductors Py to Pc. Therefore, cost can also be reduced by sharing of components. Further, arrangement positions of the developing devices Gy to Gk with respect to the photoconductor Py to Pk can be changed by changing only a posit in of a magnetic pole (particularly, the development magnetic pole S1) of the magnet roll 6*k*. Therefore, the centers of rotations of the developing devices Gy to Gk can be arranged in positions upper than the centers of rotations of the photoconductors Py to Pk, and horizontal sizes of each of the toner image forming devices UY to UK can be miniaturized. As a result of this, the image forming apparatus U can be miniaturized.

The embodiment of the invention has been described above in detail, but the invention is not limited to the embodiment and various modifications can be made within the subject matter of the invention.

The invention is not limited to a copying machine, and can be applied to an image forming apparatus such as a printer, a FAX and a complex machine.

In the embodiment, it is not limited to the image forming apparatus U having the developing devices Gy to Gk of four colors of Y, M, C, K, but it can also be applied to an image forming apparatus having developing devices Gy to Gk of two colors, three colors or five colors or more.

In the embodiment, a position of only the development magnetic pole S1 has been changed in the magnet rolls of K color and other colors, but it s not limited to this and positions of other magnetic soles S2, N1 to N3 can also be changed.

In the embodiments, an outer diameter of only one photoconductor of Pk of K color of four colors has been increased but it is not limited to this and outer diameters of plural photoconductors can also be increased.

In the embodiment, the corona dischargers have been used as all the charging devices, but a charging roll can also be used. However, it is desirable to use a corona discharger as a charging device of K (black) in order to improve productivity of black and white images. Therefore, for example, a corona discharger (Corotron or Scorotron) can also be used as a charging device of K and charging rolls can also be used as charging devices of Y, M, C.

In the embodiment, the common diameters have been used as the diameters of all the magnet rolls, but it is not limited to this and, for example, according to a diameter of a photoconductor, a diameter of a black magnet roll can also be formed larger than diameters of magnet rolls of other colors.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

The entire disclosure of Japanese Patent Application No. 2004-257338 filed on Sep. 3, 2004 including specification, claims, drawings and abstract is incorporated herein by reference in its entirety.

What is claimed is:

1. An image forming apparatus comprising:

a plurality of toner image forming devices, each comprising:

a rotating photoconductor;

a charging device that uniformly charges a surface of the photoconductor;

a latent image forming device that forms an electrostatic latent image on the surface of the charged photoconductor;

a developing device that develops the electrostatic latent image on the surface of the photoconductor to a toner image; and a developing container that contains toner used by the developing device, wherein a diameter of the photoconductor of at least one toner image forming device of the plurality of toner image forming devices is formed larger than a diameter of the photoconductor of the other toner image forming devices, each developing container of all the toner image forming devices is formed in equal-sized, and a center of rotation of a developing roll of each developing device is arranged in a position upper than a center of rotation of each photoconductor;

wherein each developing roll comprises a magnet roll having a plurality of magnetic poles, and a diameter of the magnet roll of each toner image forming device is set equally;

wherein arrangement positions of the plurality of magnetic poles of the magnet roll of the developing device arranged to face the photoconductor having the larger diameter is different from arrangement positions of the plurality of magnetic poles of the magnet roll of the other developing devices arranged to face the photoconductor other than the photoconductor having the larger diameter.

2. The image forming apparatus according to claim 1, wherein an arrangement position of a development magnetic pole among the plurality of magnetic poles of the magnet roll of the developing device arranged to face the photoconductor having the larger diameter is different from an arrangement position of a development magnetic pole of the magnet roll of the other developing devices arranged to face the photoconductor other than the photoconductor having the larger diameter.

3. The image forming apparatus according to claim 1, wherein the center of the rotation of the developing roll corresponding to the photoconductor having the larger diameter is higher than the centers of the rotation of the other developing rolls.

4. The image forming apparatus according to claim 1, wherein:

all the developing devices have the same size, and all the developing devices have the same configuration except the arrangement positions of the magnetic poles.

5. The image forming apparatus according to claim 1, the other developing rolls have the same configuration in the arrangement positions of the magnetic poles.

6. The image forming apparatus according to claim 1, wherein an angle between (i) a line connecting the center of the rotation of the photoconductor having the larger diameter and the center of the rotation of the developing roll corresponding to the photoconductor drum having the larger diameter and (ii) a horizontal line is smaller than an angle between (i) a line connecting the center of the rotation of each of the other photoconductors and the developing roll corresponding to each of the other photoconductors and (ii) the horizontal line.

* * * * *